US008052471B1

(12) United States Patent
Xiong et al.

(10) Patent No.: US 8,052,471 B1
(45) Date of Patent: Nov. 8, 2011

(54) ELECTRICAL CONNECTOR WITH IMPROVED HOUSINGS FOR BEING ASSEMBLED CONVENIENTLY

(75) Inventors: Feng Xiong, Kunshan (CN); Zi-Qiang Zhu, Kunshan (CN); Hong-Qiang Han, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/097,079

(22) Filed: Apr. 29, 2011

(30) Foreign Application Priority Data

Jul. 24, 2010 (CN) ..... 2010 2 0269736

(51) Int. Cl.
*H01R 13/648* (2006.01)

(52) U.S. Cl. ..... 439/607.01

(58) Field of Classification Search ..... 439/607.01, 439/607.02, 939, 108, 101
See application file for complete search history.

(56) References Cited

U.S. PATENT DOCUMENTS 6,171,142 B1 * 1/2001 Wang et al. ..... 439/567
6,354,878 B1 * 3/2002 Kropa et al. ..... 439/607.41
6,524,135 B1 * 2/2003 Feldman et al. ..... 439/607.46
6,979,202 B2 * 12/2005 Benham et al. ..... 439/65
7,217,142 B1 * 5/2007 Wu ..... 439/79
7,811,131 B2 * 10/2010 Wang et al. ..... 439/607.35
7,878,864 B2 * 2/2011 Wang et al. ..... 439/668
2009/0298336 A1 * 12/2009 Xiong et al. ..... 439/607.01
2010/0210124 A1 * 8/2010 Li ..... 439/108
2010/0240233 A1 * 9/2010 Johnescu et al. ..... 439/108
2011/0045709 A1 * 2/2011 Xiong et al. ..... 439/701
2011/0070753 A1 * 3/2011 Davis ..... 439/108

FOREIGN PATENT DOCUMENTS

TW M381187 5/2010

* cited by examiner

*Primary Examiner* — Tulsidas C Patel
*Assistant Examiner* — Phuong Nguyen
(74) *Attorney, Agent, or Firm* — Wei Te Chung; Andrew C. Cheng; Ming Chieh Chang

(57) ABSTRACT

An electrical connector includes a front housing having a base and a tongue forwardly extending from the base, a first rear housing, a second rear housing attached to the first rear housing, and a number of contacts. Each contact has a retaining portion retained on the first or second rear housings, a contact portion forwardly extending beyond a front end of the first and second rear housings to affix to the tongue, and a tail portion extending out of the first and second rear housings. The base is sandwiched between a front side of the first and second rear housings along a thickness direction of the tongue.

13 Claims, 6 Drawing Sheets

ELECTRICAL CONNECTOR WITH IMPROVED HOUSINGS FOR BEING ASSEMBLED CONVENIENTLY

BACKGROUND OF THE INVENTION

1. Field of the Invention

The present invention relates to an electrical connector, and more particularly to an electrical connector with improved housings for being assembled conveniently.

2. Description of Related Art

An electrical connector, mounted on a PCB for electrically connecting with a plug, is typically described in Taiwan Patent No. M381187 which was issued on May 21, 2010. The electrical connector is a DisplayPort connector which is used to transmit high frequency digital audio/video signals between a computer and its display, or a computer and a home-theater system. The electrical connector includes an insulative housing, a number of contacts retained on the housing, and a metal shell covering the housing.

The housing includes a first rear housing, a second rear housing combined to the first rear housing along a thickness direction thereof, and a front housing assembled to the first and second rear housings along a front to back direction perpendicular to the thickness direction. The front housing has a base and a tongue projecting forwardly from the base along the front to back direction. The tongue is parallel to the first rear housing and the second rear housing. The base defines a pair of position holes at a rear end thereof. The first and second rear housings are positioned to each other by a number of projections and slots therebetween and fixed together by the metal shell. The second rear housing has a pair of posts forwardly extending from a front end surface thereof to engage with the position holes, and the metal shell fixes the front housing and rear housings together along the front to back direction. The contacts include a number of first contacts assembled to the first rear housing, and a number of second contacts assembled to the second rear housing. Each contact has a securing portion secured to the rear housings, a tail portion downwardly extending out of a bottom side of the rear housings to connect with the PCB, and a contact portion forwardly extending beyond a front end surface of the rear housings. The base of the front housing defines a number of passageways extending therethrough along the front to back direction, and the tongue defines a plurality of slots at two sides thereof corresponding to the passageways. The contact portions of the contacts are arranged in two rows and extend to the slots of the tongue through the passageways along the front to back direction when the front housing is assembled to the rear housings.

As described above, the front housing is positioned to the rear housing merely via the posts on the second rear housing, which is not firm enough, and the posts are easily destroyed when the front housing is swayed along a thickness direction thereof. Besides, the front housing, the first and second rear housings are simply positioned with each other, and not fixed together before the metal shell is assembled thereto, then the front housing and rear housings would be easily dispersed with each other, which is inconvenient to be assembled. In addition, the contact portions should penetrate through the passageways to expose to two sides of the tongue for electrically connecting with the plug in an assembling process of the front housing, then the contact portions would easily rub against the inner surfaces of the passageways to make the scrap adhere to the contact portions, which affect a high frequency of the electrical connector.

Hence, an improved electrical connector is desired to overcome the above problems.

BRIEF SUMMARY OF THE INVENTION

According to the present invention, an electrical connector, comprises: a front housing having a base and a tongue forwardly extending from the base; a first rear housing; a second rear housing attached to the first rear housing; and a plurality of contacts. Each contact has a retaining portion retained on the first or second rear housings, a contact portion forwardly extending beyond a front end of the first and second rear housings to affix to the tongue, and a tail portion extending out of the first and second rear housings. The base is sandwiched between a front side of the first and second rear housings along a thickness direction of the tongue.

According to another aspect of the present invention, an electrical connector, comprises: a front housing having a base and a tongue; a first rear housing engaging with the front housing along a thickness direction of the tongue; a second rear housing assembled to the first rear housing along the thickness direction to sandwiched the front housing therebetween; and a plurality of contacts. The tongue defines a plurality of recesses at two sides thereof. The contacts comprise a plurality of first contacts assembled to the first rear housing along the thickness direction and a plurality of second contacts assembled to the second rear housing along the thickness direction. Each contact has a contact portion assembled to the recesses along the thickness direction.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
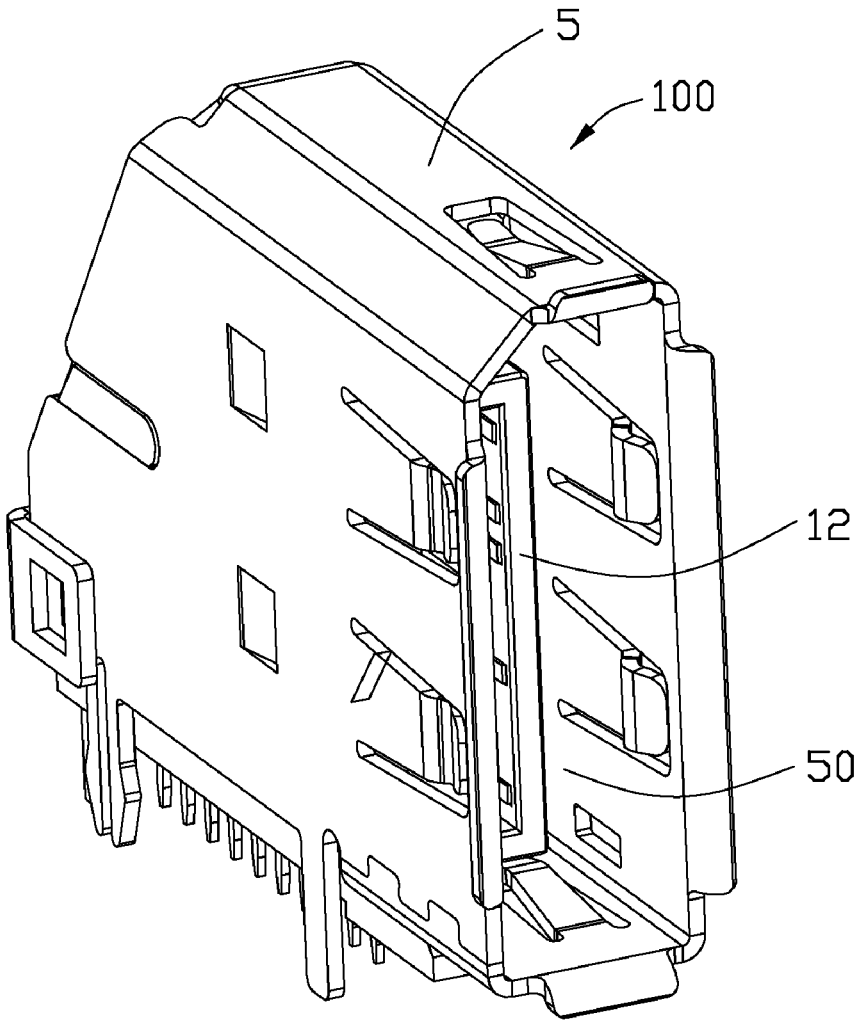
FIG. 1 is a perspective view of an electrical connector according to the present invention.

In the following description, numerous specific details are set forth to provide a thorough understanding of the present invention. However, it will be obvious to those skilled in the art that the present invention may be practiced without such specific details.

Referring to FIGS. 1-6, an electrical connector 100 according to the present invention is disclosed. The electrical connector 100 is an upright DisplayPort connector and is used to mounted to a PCB (not shown) for connecting with a corresponding plug (not shown). The electrical connector 100 comprises an insulative front housing 1, an insulative first rear housing 2 and second rear housing 3, a plurality of contacts 4 retained to the first and second rear housings 2, 3, and a metal shell 5 covering the front housing 1, the first rear housing 2 and the second rear housing 3.

Figure 5:
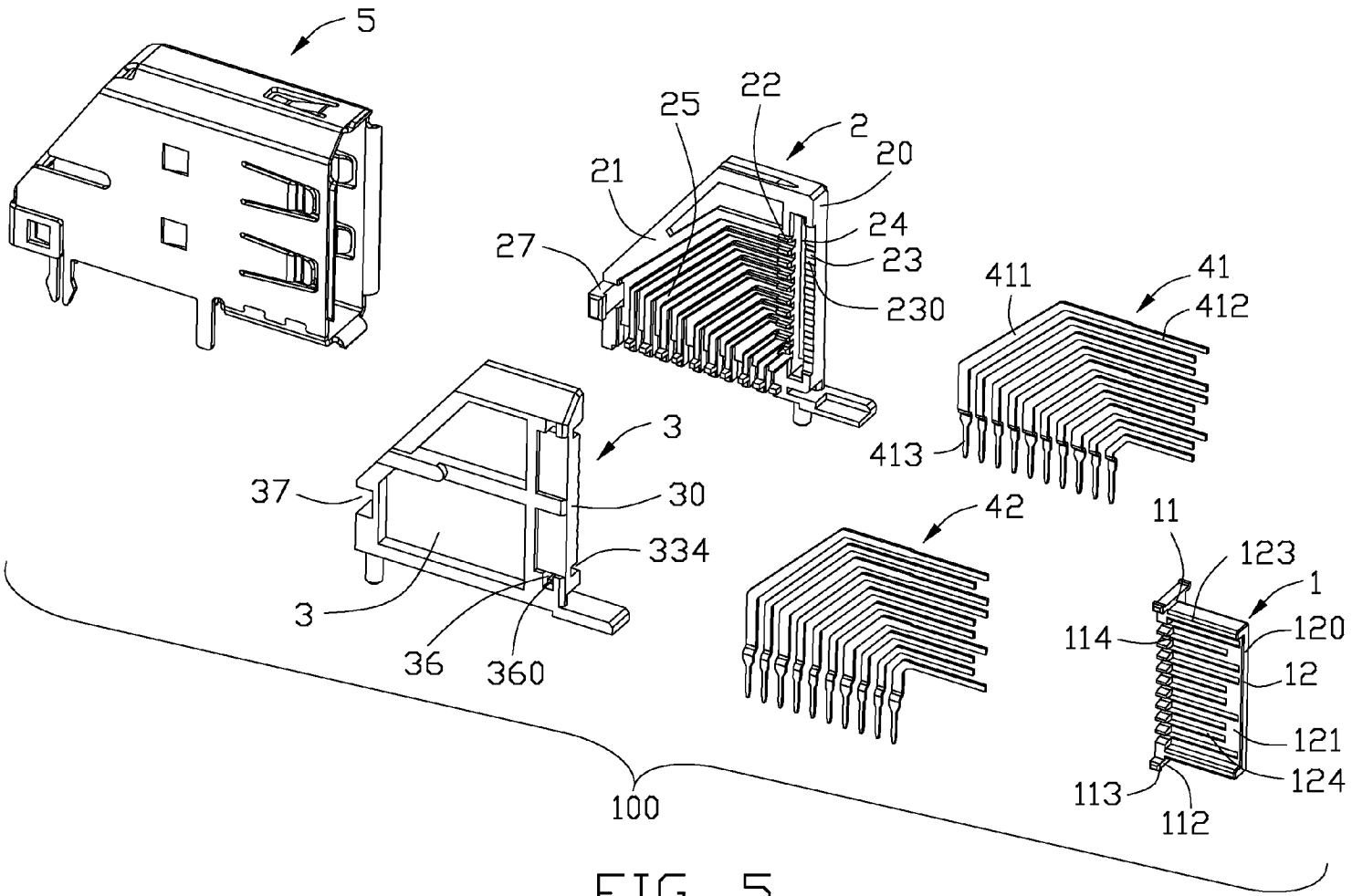
FIG. 5 is an exploded view of the electrical connector shown in FIG. 1.
Figure 6:
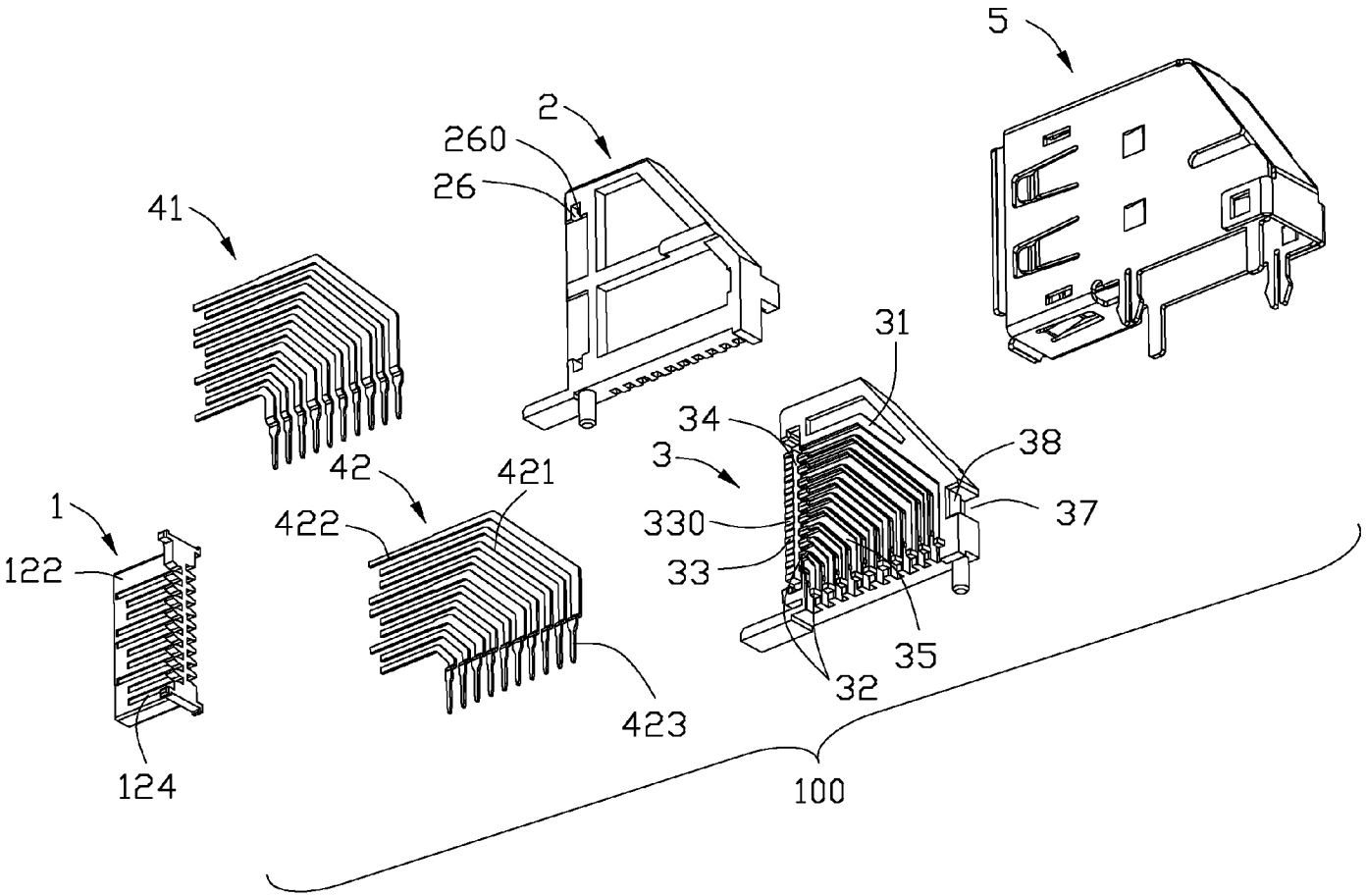
FIG. 6 is a view similar to FIG. 5, while taken from a different aspect.

Referring to FIGS. 5 and 6, the front housing 1 has a base 11 and a tongue 12 forwardly extending from a front end of the base 11. The tongue 12 has a first surface 121 and a second surface 122 respectively located at two sides thereof, and a pair of projections 123 projecting outwardly from upper and lower ends of the first surface 121 respectively. The tongue 12 defines a plurality of recesses 124 which are arranged in two rows and are respectively recessed from the first surface 121 and the second surface 122. The base 11 defines a plurality of slots 114 communicating with and aligning to the recesses 124 along a front to back direction. The slots 114 and the recesses 124 open to the air along a thickness direction of the tongue 12. The front to back direction is perpendicular to the thickness direction. The base 11 is formed with four locking arms 112 extending outwardly from four corners thereof along the thickness direction. Each locking arm 112 is formed with a locking protrusion 113 at a free end thereof.

The first rear housing 2 and the second rear housing 3 are combined to each other along a thickness direction of the tongue 12. The first rear housing 2, the second rear housing 3 and the tongue 12 are flat and parallel to each other. The tongue 12 defines a mating surface 120 at a front end thereof. The mating surface 120 is perpendicular to the first surface 121 and the second surface 122. The first rear housing 2 and the second rear housing 3 define a mounting surface 29 at a lower end thereof to be set on the PCB. The mounting surface 29 is perpendicular to the mating surface 120, the first surface 121 and the second surface 121.

The first rear housing 2 has a first front end surface 20, a first inner surface 21, a plurality of first grooves 25 recessed from the first inner surface 21, a plurality of first blocks 22 extending toward the second rear housing 3 from the first inner surface 21 along the thickness direction, and a first cavity 24 recessed from a front side of the first inner surface 21. The first front end surface 20 is parallel to the mating surface 120 of the tongue 12. The first inner surface 21 is perpendicular to the first front end surface 20 and the mounting surface 29. The first grooves 25 are inflective and extend from a front side of the first inner surface 21 to the mounting surface 29 (referring to FIG. 2). The first blocks 22 are located between adjacent first grooves 25, and arranged in two groups which are respectively located at a front end of the first grooves 25 and a lower end of the first grooves 25.

The first rear housing 2 further defines a first depression portion 23 recessed from a front end of the first inner surface 21 to receive a rear end of the tongue 12. The first cavity 24 is located between the depression portion 23 and the first grooves 25 and communicates with the depression portion 23 and the first grooves 25 along the front to back direction. The first cavity 24 defines a depth which is deeper than that of the first grooves 25 and the depression portion 23. The first rear housing 2 has a hook 27 extending toward the second rear housing 3 from a rear end thereof.

The second rear housing 3 has a second front end surface 30, a second inner surface 31, a plurality of second grooves 35 recessed from the second inner surface 31, a plurality of second blocks 32 extending toward the first rear housing 2 along the thickness direction from the second inner surface 31, and a second cavity 34 recessed from a front side of the second inner surface 31. The second front end surface 30 is parallel to the mating surface 120 of the tongue 12. The second inner surface 31 is perpendicular to the second front end surface 30 and the mounting surface 29 (referring to FIG. 2). The second grooves 35 are inflective and extend from a front side of the second inner surface 31 to the mounting surface 29. The second blocks 32 are located between adjacent second grooves 35, and arranged in two groups which are respectively located at a front end of the second grooves 35 and a lower end of the second grooves 35.

The second rear housing 3 further defines a second depression portion 33 recessed from a front end of the second inner surface 31 to receive a rear end of the tongue 12. The second cavity 34 is located between the depression portion 33 and the second grooves 35 and communicates with the depression portion 33 and the second grooves 35 along the front to back direction. The second cavity 34 defines a depth which is deeper than that of the second grooves 35 and the depression portion 33. The second rear housing 3 defines a locking slot 37 at a rear end thereof to lock with the hook 27, which can fasten rear ends of the first and second rear housings 2, 3 together.

The first blocks 22 and the second blocks 32 are staggered when the first and second rear housings 2, 3 are combined together. The first and second grooves 25, 35 are staggered too. The first and second cavities 24, 34 are aligned to each other along the thickness direction and communicate with each other to retain the base 11 of the front housing 1. The depression portions 23, 33 communicate with each other to receive the rear end of the tongue 12. The second rear housing 3 further defines a pair of cutouts 334 recessed from the upper and lower ends of the second depression portion 33 to receive the projections 123 of the tongue 12. The first and second rear housings 2, 3 define two pairs of locking holes 26, 36 extending therethrough along the thickness direction. The locking holes 26, 36 are located at the upper and lower ends of the first and second cavities 24, 34 and communicate with the first and second cavities 24, 34 along the thickness direction to lock with the locking arms 112 of the base 11. The locking holes 26, 36 are formed with step-liked inner walls 260, 360 respectively to lock the locking protrusions 113 along the thickness direction.

The contacts 4 comprise a plurality of first contacts 41 which are arranged in a row, and a plurality of second contacts 42 which are arranged in another row and parallel to the first contacts 41. Each first contact 41 has a first retaining portion 411, a first contact portion 412 forwardly extending out of the first front end surface 20 from a front end of the first retaining portion 411, and a first tail portion 413 downwardly extending out of the mounting surface 29. The first retaining portions 411 are received in the first grooves 25 and pressed by the second blocks 32 on the second rear housing 3 along the thickness direction. The front end of the first retaining portions 411 are positioned in the slots 114 of the base 11. The first contact portions 412 are received in the recesses 124 of the second surface 122 of the tongue 12. The first rear housing 2 is formed with a plurality of ribs 230 protruding outwardly from an inner wall of the first depression portion 23 to resist the first contact portions 412.

Each second contact 42 has a second retaining portion 421, a second contact portion 422 forwardly extending out of the second front end surface 30 from a front end of the second retaining portion 421, and a second tail portion 423 downwardly extending out of the mounting surface 29. The second retaining portion 421 are received in the second grooves 35 and pressed by the first blocks 22 of the first rear housing 2 along the thickness direction. The front end of the second retaining portions 421 are positioned in the slots 114 of the base 11. The second contact portions 422 are received in the recesses 124 of the first surface 121 of the tongue 12. The second rear housing 3 is formed with a plurality of ribs 330 protruding outwardly from an inner wall of the second depression portion 33 to resist the second contact portions 422.

Figure 2:
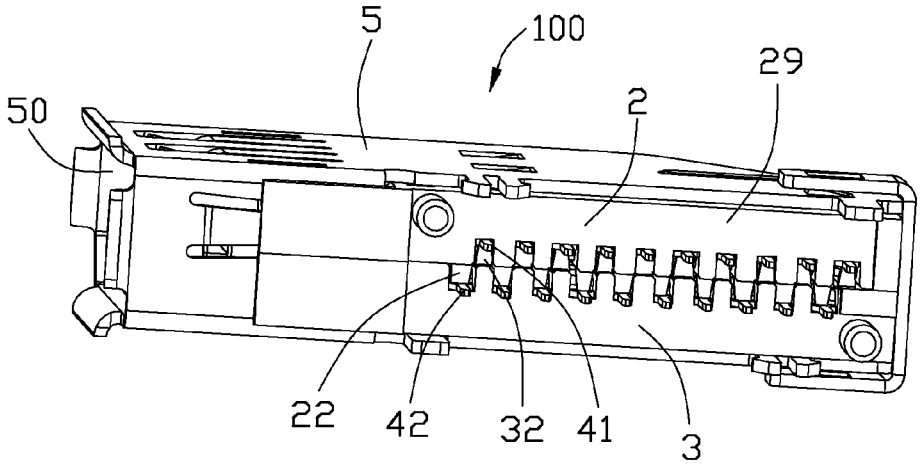
FIG. 2 is a view similar to FIG. 1, while taken from a different aspect.
Figure 3:
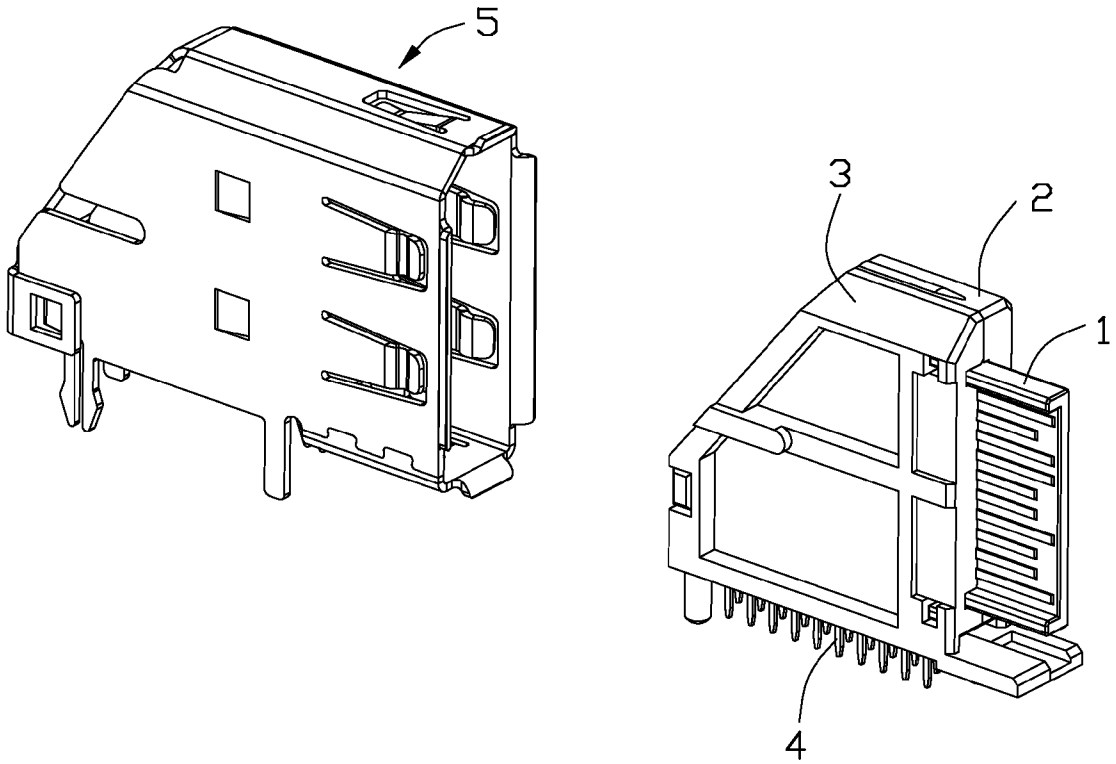
FIG. 3 is a partly exploded view of the electrical connector shown in FIG. 1.
Figure 4:
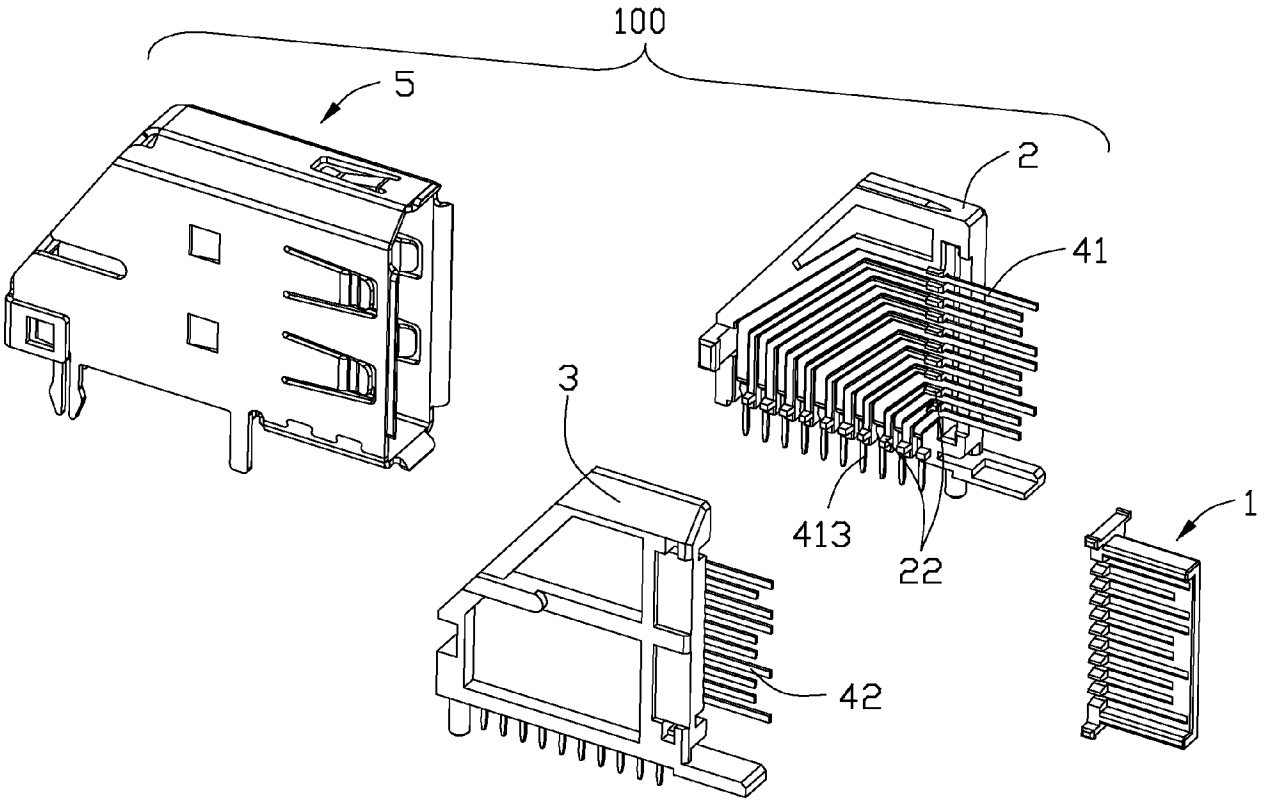
FIG. 4 is a further exploded view of the electrical connector shown in FIG. 3.

Referring to FIGS. 1-3, the metal shell 5 defines a mating opening 50 around the tongue 12. The first and second contact portions 412, 422 are exposed to the mating opening 50 along the thickness direction to electrically connect with the corresponding plug.

In assembly, firstly, assembling the first contacts 41 to the first rear housing 2 along the thickness direction, then the first retaining portions 411 are retained in the first grooves 25; secondly, assembling the second contacts 42 to the second rear housing 3 along the thickness direction, then the second retaining portions 421 are retained in the second grooves 35; thirdly, assembling the front housing 1 to the first rear housing 3 along the thickness direction, then the locking arms 112 on one side of the base 11 lock with the locking holes 26 of the first rear housing 2 to fix the front housing 1 to the second rear housing 2, and the front end of the first retaining portions 411 are positioned in the slots 114 of the base 11, and the first contact portions 412 are received in the recesses 124 of the second surface 122 along the thickness direction; fourthly, assembling the second rear housing 3 and the second contacts 42 to the first rear housing 2 along the thickness direction, then the locking arms 112 on another side of the base 11 lock with the locking holes 36 of the second rear housing 3 to fix the front side of the second rear housing 3, the base 11 of the front housing 1 and the front side of the first rear housing 2 together, and the hook 27 locks with the locking slot 37 to fix the rear side of the first and second rear housings 2, 3 together, and the front end of the second retaining portions 421 are positioned in the slots 114 of the base 11, and the first contact portions 422 are received in the recesses 124 of the first surface 121 along the thickness direction; finally, assembling the metal shell 5 to the front housing 1, the first rear housing 2 and the second rear housing 3.

As fully described above, before the metal shell 5 is assembled to the housings 1, 2, 3, the housings 1, 2, 3 are fixed together via the locking arms 112 engage with the locking holes 26, 36, and the hook 27 engages with the locking slot 37, which would make the electrical connector 100 of the present invention be assembled conveniently; besides, the contacts 4 are assembled to the front housing 1, the first and second rear housings 2, 3 along the thickness direction, and the grooves 25, 35 the recesses 124 and the slots 114 open to the air along the thickness direction, thereby, the contacts 4 need not penetrate any passageways along the front to back direction in the assembling process, then the front housing 1 can not be rubbed, and the contacts 4 will not be disturbed by scrap and will have a good environment to transmit high frequency signals. In addition, the base 11 and a rear end of the tongue 12 are sandwiched between the first and second housings 2, 3 along the thickness direction, and the base 11 is fully received in the cavities 24, 34, which can assure the electrical connector 100 of the present invention with a firm structure.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector, comprising:

a front housing having a base and a tongue forwardly extending from the base;

a first rear housing;

a second rear housing attached to the first rear housing; and a plurality of contacts, each contact having a retaining portion retained on the first or second rear housings, a contact portion forwardly extending beyond a front end of the first and second rear housings to affix to the tongue, and a tail portion extending out of the first and second rear housings;

wherein the base is sandwiched between a front side of the first and second rear housings along a thickness direction of the tongue;

the plurality of contacts comprising a group of pairs of differential contacts, each pair of the differential contacts being equipped with at least a grounding contact by one side;

wherein the first rear housing has a hook extending toward the second rear housing at a rear end thereof, and the second rear housing defines a locking slot at a rear end thereof to lock with the hook for fixing a rear side of the first and second rear housings together;

wherein each locking arm has a locking protrusion at a free end thereof, and the locking hole extends through the first and second rear housings and is formed with a step-like inner wall to lock with the locking protrusion, and the locking holes communicate with the first and second cavities respectively.

2. The electrical connector according to claim 1, wherein the first rear housing defines a first inner surface and a first cavity recessed from a front side of the first inner surface, and the second rear housing defines a second inner surface facing to the first inner surface and a second cavity recessed from a front side of the second inner surface, and the base is received and retained in the first and second cavities.

3. The electrical connector according to claim 2, wherein the base is formed with at least a pair of locking arms extending outwardly toward the first and second rear housings respectively, and each of the first and second rear housings defines a locking hole to lock with the locking arm for fixing the front housing, the first rear housing and the second rear housing together.

4. The electrical connector according to claim 2, wherein the first rear housing has a plurality of first grooves recessed from the first inner surface thereof and a plurality of first blocks protruding toward the second rear housing between adjacent first grooves, the contacts comprise a plurality of first contacts, and the retaining portions of the first contacts are received in the first grooves.

5. The electrical connector according to claim 4, wherein the second rear housing has a plurality of second grooves corresponding to the first blocks, and a plurality of second blocks between adjacent second grooves to press the retaining portions in the first grooves, and the contacts comprise a plurality of second contacts, and the retaining portions of the second contacts are received in the second grooves and pressed by the first blocks.

6. The electrical connector according to claim 2, wherein the tongue defines a plurality of recesses at two sides thereof to receive the contact portions along a thickness direction thereof, and the base defines a plurality of slots corresponding to the recesses along a front to back direction, the slots and the recesses open to the air along the thickness direction to receive the contacts.

7. The electrical connector according to claim 6, wherein each of the first and second rear housings further defines a depression portion at a front end thereof to receive a rear end of the tongue, and the depression portion defines a depth which is shallower than that of the first and second cavities.

8. The electrical connector according to claim 7, wherein the first and second rear housings are formed with a plurality of ribs protruding outwardly from an inner wall of the depression portions toward the recesses to press a rear side of the contact portions.

9. An electrical connector, comprising:

a front housing having a base and a tongue, the tongue defining a plurality of recesses at two sides thereof;

a first rear housing engaging with the front housing along a thickness direction of the tongue;

a second rear housing assembled to the first rear housing along the thickness direction to sandwiched the front housing therebetween; and a plurality of contacts comprising a plurality of first contacts assembled to the first rear housing along the thickness direction and a plurality of second contacts assembled to the second rear housing along the thickness direction, each contact having a contact portion assembled to the recesses along the thickness direction;

the plurality of contacts comprising a group of pairs of differential contacts, each pair of the differential contacts being equipped with at least a grounding contact by one side;

wherein the first rear housing has a hook extending toward the second rear housing at a rear end thereof, and the second rear housing defines a locking slot at a rear end thereof to lock with the hook for fixing the rear sides of the first and second rear housings together;

wherein each of the first and second rear housings has a plurality of grooves recessed from the inner surface thereof and a plurality of blocks between adjacent grooves, each contact has a retaining portion attached to the grooves on one of the first and second rear housings and pressed by the blocks on the other rear housing, the contact portions forwardly extend beyond the first and second housings.

10. The electrical connector according to claim 9, wherein the first rear housing defines a first inner surface and a first cavity recessed from a front side of the first inner surface, and the second rear housing defines a second inner surface facing to the first inner surface and a second cavity recessed from a front side of the second inner surface, and the base is received and retained in the first and second cavities.

11. The electrical connector according to claim 10, wherein the base is formed with at least one pair of locking arms outwardly extending along the thickness direction, and each of the first and second rear housings defines a locking hole extending therethrough along the thickness direction to lock with the locking arms, the locking holes communicate with the first and second cavities along the thickness direction.

12. An electrical connector, comprising:

a first set of contacts located in a first vertical plane, each of said first set of contacts defining a front first mating section and a rear first mounting section in a front-to-back direction;

a second set of contacts located in a second vertical plane closely parallel to the first vertical plane, each of said second set of contacts defining a front second mating section and a rear second mounting section in said front-to-back direction;

the plurality of contacts comprising a group of pairs of differential contacts, each pair of the differential contacts being equipped with at least a grounding contact by one side;

an insulative housing to hold both said first set of contacts and said second set of contacts in position, said housing including a front part to regulate the front first and second mating sections, and a rear part to regulate the rear first and second mounting sections, said rear part defining first and second pieces side by side assembled together to respectively hold the rear first mounting sections of the first set of contacts and the rear second mounting sections of second set of contacts therein so as to commonly sandwich both the rear first mounting sections of said first set of contacts and the rear second mounting sections of said second set of contacts therebetween in a transverse direction perpendicular to both said first and second vertical plane and said front-to-back direction; wherein said front part is sandwiched by the front first mating sections of the first set of contacts and the front second mating sections of the second set of contacts in said transverse direction under condition that said front part includes a rear portion sandwiched between the first and second pieces in said transverse direction.

13. The electrical connector as claimed in claim 12, wherein said first part is configured to allow said front first mating sections of the first set of contacts and said front second mating sections of the second set of contacts to be assembled thereto in the transverse direction.

* * * * *